United States Patent [19]

Bostic, Sr., deceased

[11] Patent Number: 4,662,850

[45] Date of Patent: May 5, 1987

[54] LIFE PRESERVING DEVICE WITH PRESSURE RESPONSIVE SWITCH

[75] Inventor: Gerald D. Bostic, Sr., deceased, late of Grand Prairie, Tex., by Gerald D. Bostic, Jr., administrator

[73] Assignee: Dolphin Manufacturing, Inc., Midland, Tex.

[21] Appl. No.: 818,982

[22] Filed: Jan. 9, 1986

Related U.S. Application Data

[63] Continuation of Ser. No. 606,988, May 4, 1984, abandoned.

[51] Int. Cl.[4] ..... B63C 9/20

[52] U.S. Cl. ..... 441/123; 441/112; 441/122; 441/124

[58] Field of Search ..... 441/122-124, 441/88, 89, 80, 36, 16, 17, 11-13

[56] References Cited

U.S. PATENT DOCUMENTS

| | | | |
|---|---|---|---|
| 685,158 | 10/1901 | Maccolini | 441/122 |
| 3,266,070 | 8/1966 | O'Link | 441/112 |
| 3,400,415 | 9/1968 | Scheurer | 441/112 |
| 3,488,795 | 11/1976 | Robertson | 441/123 |
| 3,798,692 | 3/1974 | Madeley | 441/89 |
| 3,803,652 | 4/1974 | Uyehara | 441/123 |

*Primary Examiner*—Joseph F. Peters, Jr.
*Assistant Examiner*—C. T. Bartz
*Attorney, Agent, or Firm*—James E. Bradley

[57] ABSTRACT

A life preserving device is shown having a body portion with a pair of floating sections which extend in opposite directions from a centrally located fold. Each of the floating sections has an aperture adapted to receive a wearer's head. The floating sections are foldable together along the central fold for use by a single wearer with the single wearer's head passing through both of the apertures. The floating sections are foldable apart for use by two wearers with each of the wearer's heads passing through a selected one of the apertures. A pressure sensing switch is shown for use with the life preserving device. The pressure sensing switch includes a pressure sensing membrane which is affixed to the body and which is responsive to an increase in inflation pressure within the floating section of the body to complete and actuate an electrical circuit. The electrical circuit can be used to power a radio transmitter to transmit a distress signal.

3 Claims, 4 Drawing Figures

LIFE PRESERVING DEVICE WITH PRESSURE RESPONSIVE SWITCH

This application is a continuation, of application Ser. No. 606,988, filed 5/04/84, now abandoned.

BACKGROUND OF THE INVENTION

The present invention relates to life preserving flotation devices and, specifically, to a foldable life preserving jacket and a pressure responsive switch for use with the jacket.

Many types of life jackets, such as those used on large vessels, are filled with cork, kapok, or other buoyant materials to provide a floating jacket which is ready for immediate use. Because such buoyant materials sometimes make the jacket bulky, there is a tendency not to wear the jacket until an actual need arises. When an emergency occurs, there are oftentimes some survivors in the water without life preserving devices. As a result, it is advantageous for a survivor wearing a life jacket to be able to share the jacket without unduly endangering the wearers own life.

Another problem is locating survivors in the sea. Some life preserving devices are equipped with radio transmitters which transmit a distress signal upon actuation by the wearer in an emergency. Because such devices are used in times of great stress, there can be no time wasted fumbling with latches, pins or cords in order to make the survival device operative. In the case of an airplane crash, the survivor might be unconscious in the water and be unable to actuate the radio transmitter or other survival device associated with the jacket.

U.S. Pat. No. 3,041,021 to Jaffe, issued June 26, 1962, shows a life jacket with a radio receiver affixed to the jacket. The radio receives continuously transmitted signals from a transmitter on the vessel. Should the wearer fall off the vessel into the water and be separated by more than a fixed distance from the vessel transmitter, a solenoid in the radio receiver is actuated and inflates the life jacket. The system is not intended to work in the situation where the vessel is itself in danger.

U.S. Pat. No. 3,798,692 to Madeley, issued Mar. 26, 1974, shows a life jacket with a pressure responsive switch which actuates light on the life jacket when the wearer falls into the water. The pressure switch is actuated in response to contact with the water pressure of the surrounding water. The actuation device does not actuate a radio transmitter.

U.S. Pat. No. 3,095,568 to Aine, issued June 25, 1963, shows a life preserver with a pneumatic antenna erecting apparatus. Gas pressure is used to erect a mast or antenna for transmitting radio signals by a radio carried on the life preserver. The radio transmitter is not automatically actuated in response to inflation pressure.

There exists a need, therefore, for a life preserver which can be used by more than one person without endangering the life of the primary wearer.

There exists a need for a life preserving device of the type having a radio transmitter affixed thereto which incorporates a pressure responsive switch for automatically actuating the radio transmitter in response to inflation pressure.

Additional objects, features and advantages will be apparent in the written description which follows.

SUMMARY OF THE INVENTION

The life preserving device of the invention has a body with a pair of floating sections extending in opposite directions from a centrally located fold. Each of the floating sections has an aperture adapted to receive a wearer's head. The floating sections are foldable together along the central fold for use by a single wearer with the single wearer's head passing through both of the apertures. The floating sections are also foldable apart for use by two wearers with each of the wearer's heads passing through a selected one of the apertures.

The life preserving device can also have a pressure sensing means affixed to the body which is adapted to emit an electrical signal in response to an increase in inflation pressure inside the body. Preferably the pressure sensing means is a pressure sensing membrane which is affixed to the body. The membrane has an inner wall area which is exposed to the interior of the body and which is acted upon by changes in gas pressure inside the body. The membrane is positionable by an increase in gas pressure inside the body between a relaxed position and an outwardly deformed position. Electrical circuit means are provided responsive to the membrane position which are actuated by movement of the membrane to the outwardly deformed position. The electrical circuit means can include an electrical power supply connected in an electrical circuit between a pair of electrical contacts. One of the electrical contacts is engaged by the membrane at all times. The other of the contacts is engaged by the membrane to energize and complete the electrical circuit when the membrane moves to the outwardly deformed position in response to an increase in gas pressure within the body.

DETAILED DESCRIPTION OF THE INVENTION

Figure 2:
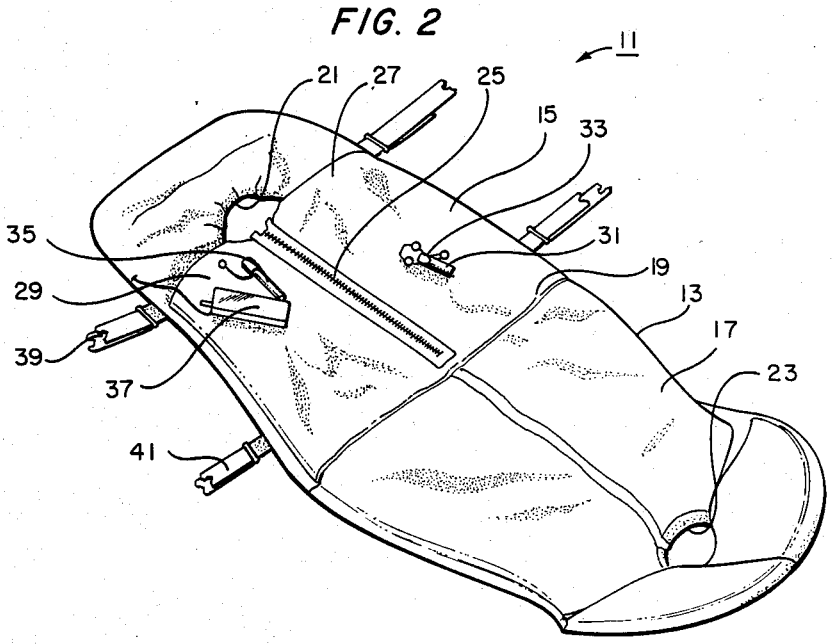
FIG. 2 is a top perspective view of the life preserving device of the invention in the folded apart position.

Referring to FIG. 2 there is shown a life preserving device of the invention designated generally as 11. The life preserving device 11 includes a body 13 having a pair of floating sections including a top section 15 and a bottom section 17. The sections 15, 17 extend in opposite directions from a centrally located fold 19. As shown in FIG. 2, each of the folding sections 15, 17 has an aperture 21, 23 adapted to receive a wearer's head.

Preferably the top section 15 has a central zipper 25 which divides a pair of hollow, inflatable portions 27, 29. The inflatable portions 27, 29 are hollow cavities which are covered with nylon twill having an elastomeric coating. The inflatable portions 27, 29 are inflated by a conventional gas cartridge 31 which, when actuated, supplies inflation pressure to the interior of the inflatable portions 27, 29. The gas cartridge 31 is commercially available and can be actuated, as by a pull cord 33, or can be automatically actuated by contact with the water.

The life preserving device also has an oral inflating tube 35 as a back-up for the gas cartridge 31 and is equipped with a radio transmitter 37 which is affixed to the device 11 and which is actuable to transmit a distress signal, as will be described. The top section 15 also has body straps 39, 41 for securing the device 11 to the wearer's chest.

The bottom section 17 of the life preserving device 11 can have an outer skin of nylon covered by an elastometic coating but contains a material which is itself buoyant in water. For instance, the bottom section 17 could contain a buoyant foam, cork, kapok or the like. Although the device 11 could be provided with a bottom section 17 identical in construction to top section 15, the buoyant foam bottom would continue to float even if the top section were punctured during an emergency.

Figure 3:
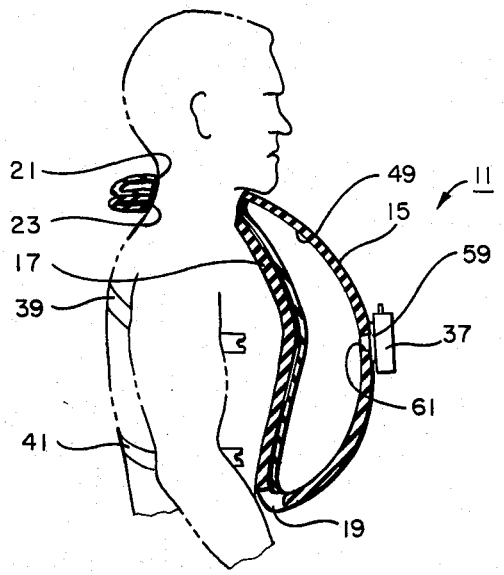
FIG. 3 is a side, cross-sectional view of the life preserving device of FIG. 2 in the folded position on a single wearer.
Figure 4:
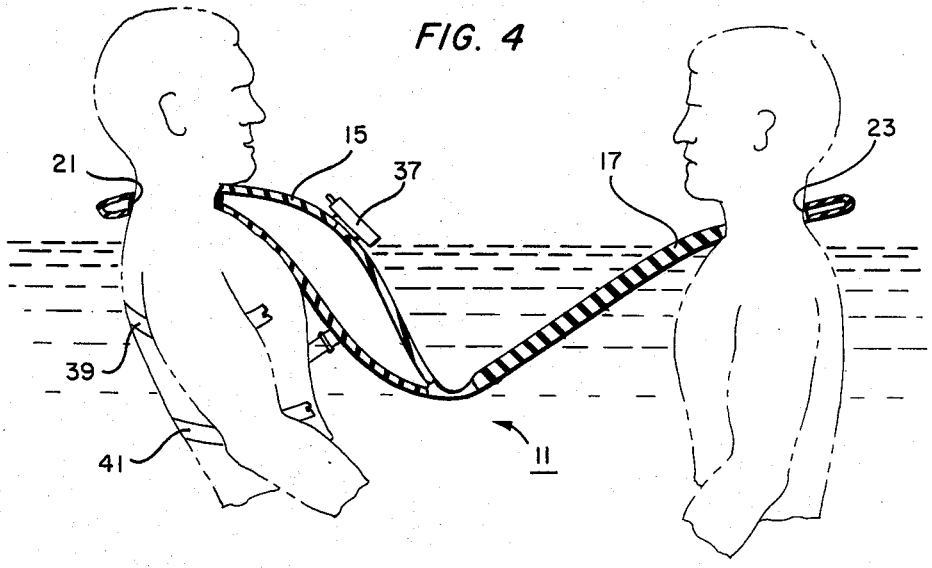
FIG. 4 is a side, cross-sectional view of the life preserving device in the folded apart position being shared by two wearers.

The operation of the foldable life preserving device 11 is illustrated in FIGS. 3 and 4. As shown in FIG. 3, the sections 15, 17 are foldable together along the central fold 19 for use by a single wearer with the single wearer's head passing through both of the apertures 21, 23. Should it become necessary, the device 11 is foldable apart, as shown in FIG. 4, for use by two wearers with the wearer's heads passing through a selected one of the apertures 21, 23.

Figure 1:
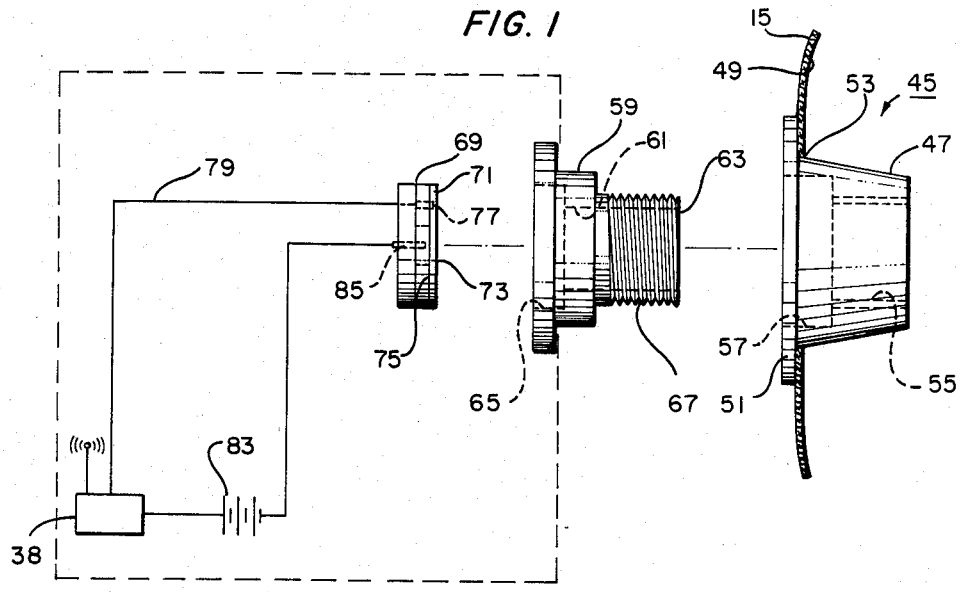
FIG. 1 is a close up side view of the pressure responsive switch used with the life preserving device showing the life preserving device in cross section and partly broken away and showing a schematic of the electrical circuit associated with the switch.

FIG. 1 illustrates the pressure sensing means of the invention which is adapted to be used with the life preserving device 11. The pressure sensing means includes a mounting receptacle 45 having an interior conical portion 47 which adapted to extend within the hollow body cavity 49 of the floating section 15 where it is retained in position by an outer flange 51. The conical portion 47 could conveniently be inserted within an opening 53 in the section 15 and sealed with a suitable glue. The conical portion 47 includes a lower threaded interior region 55 which joins an upper stepped interior region 57.

The radio transmitter 37 is housed within a molded plastic water tight case (shown as dotted lines in FIG. 1) and has a male mounting element 59 rigidly affixed to the case. The mounting element 59 has a cylindrical bore 61 which communicates with an open end 63 and has a region of greater internal diameter 65. The male element 59 has a threaded extent 67 which is designed to matingly engage the threaded interior region 55 of the mounting receptacle 45.

The region of greater internal diameter 65 of the mounting element 59 is adapted to receive a disk element 69 which contains a flexible membrane 71. The flexible membrane 71 has an inner wall area 73 and an outer wall area 75. The flexible membrane 71 is either made entirely of a conductive material or can be, for instance, a rubber element which has a conductive coating on the outer wall area 75. An electrical circuit is associated with the flexible membrane 71 and is actuated by movement of the membrane 71 between a relaxed position as shown in FIG. 1 and a deformed position.

As shown in FIG. 1, the membrane 71 has an electrical contact 77 which is embedded within the flexible membrane 71 and which is connected through a circuit 79 to the transmitting element 38 of the radio transmitter 37 and, in turn, to a power source 83. The power source 83 is connected to a second electrical contact 85 which is mounted within the disk element 69 but which does not contact the flexible membrane 71 in the relaxed position. It will be appreciated that the electrical circuit 79 is "open" when the membrane 71 is in the position shown. As the hollow body cavity 49 of the life preserving device 11 is inflated, gas pressure acts through the cylindrical bore 61 on the flexible membrane inner wall area 73 to outwardly deform the wall area into contact with the second electrical contact 85 to complete and energize the electrical circuit.

In operation, the life preserving device 11 would be inflated by the wearer, either automatically upon contact with the water rising commercially available inflation devices or by pulling the pull cord 33 of the gas cartridge 31. As the hollow body cavity 49 inflates to the position shown in FIG. 3, the gas pressure is communicated through the bore 61 to the membrane 71 (FIG. 1) located within the mounting element 59. The deformation of the membrane 71 energizes the electrical circuit and causes the radio transmitter 37 to transmit distress signals. It will be understood that the electrical signal could be routed to other equipment as well, such as a signal light or the like.

While the invention has been shown in only two of its forms, it is not thus limited but is susceptible to various changes and modifications without parting from the spirit thereof.

I claim:

1. A life preserving device, comprising:

a one piece, elongated body defining a pair of floating sections connected together by a centrally located horizontal fold, each of said floating sections being symmetrical about an imaginary vertical axis drawn to bisect said horizontal fold, each of said floating sections having an aperture on an opposite side of said centrally located fold adapted to receive a wearer's head, each of said apertures being centered on said imaginary vertical axis which is drawn to bisect said horizontal fold, said floating sections being foldable between a first position for use by a single wearer with both of said sections overlaying the single wearer's chest and with both of said apertures aligned with the single wearer's head passing through both of said apertures, and with the centrally located fold generally overlaying the single wearer's waist, and said floating sections being foldable apart to a second position with said apertures adjacent one another and facing generally upwardly for use by two wearers with each of said wearer's heads passing through a selected one of said apertures; and wherein said imaginary vertical axis drawn to bisect said horizontal fold overlays a vertical opening running from at least one of said apertures in the direction of said horizontal fold.

2. A life preserving device, comprising:

a one piece, elongated body defining a pair of floating sections connected together by a centrally located horizontal fold, each of said floating sections being symmetrical about an imaginary vertical axis drawn to bisect said horizontal fold, each of said floating sections having an aperture on an opposite side of said centrally located fold adapted to receive a wearer's head, each of said apertures being centered on said imaginary vertical axis which is drawn to bisect said horizontal fold, said floating sections being foldable between a first position for use by a single wearer with both of said sections overlaying the single wearer's chest and with both of said apertures aligned with the single wearer's head passing through both of said apertures, and with the centrally located fold generally overlaying the single wearer's waist, and said sections being foldable apart to a second position with said apertures adjacent one another and facing generally upwardly for use by two wearers with each of said wearer's heads passing through a selected one of said apertures; and wherein said imaginary vertical axis drawn to bisect said horizontal fold overlays a vertical zipper opening running from each of said apertures in the direction of said horizontal fold.

3. A life preserving device, comprising:

a one piece, elongated body defining a pair of floating sections connected together by a centrally located fold, each of said floating sections having an aperture on an opposite side of said centrally located fold adapted to receive a wearer's head, said floating sections being foldable between a first position for use by a single wearer with both of said sections overlaying the single wearer's chest and with both of said apertures aligned with the single wearer's head passing through both of said apertures and said sections being foldable apart to a second position with said apertures adjacent one another and facing generally upwardly for use by two wearers with each of said wearer's heads passing through a selected one of said apertures; and wherein one of said floating sections is of hollow, inflatable construction adapted to be inflated by a supply of gas from a suitable gas source and one of said floating sections is constructed of a solid material which is itself buoyant in water.

* * * * *